US011201443B2

(12) United States Patent
Leihenseder et al.

(10) Patent No.: US 11,201,443 B2
(45) Date of Patent: Dec. 14, 2021

(54) ELECTRICAL PLUG-IN CONNECTOR

(71) Applicant: Würth Elektronik eiSos GmbH & Co. KG, Waldenburg (DE)

(72) Inventors: Martin Leihenseder, Bretzfeld (DE); Klaus Richter, Abstatt (DE)

(73) Assignee: WÜRTH ELEKTRONIK EISOS GMBH & CO. KG

( * ) Notice: Subject to any disclaimer, the term of this patent is extended or adjusted under 35 U.S.C. 154(b) by 0 days.

(21) Appl. No.: 16/638,657

(22) PCT Filed: Aug. 2, 2018

(86) PCT No.: PCT/EP2018/071082
§ 371 (c)(1),
(2) Date: Feb. 12, 2020

(87) PCT Pub. No.: WO2019/034448
PCT Pub. Date: Feb. 21, 2019

(65) Prior Publication Data

US 2021/0135412 A1 May 6, 2021

(30) Foreign Application Priority Data

Aug. 15, 2017 (DE) ..... 10 2017 214 182.4

(51) Int. Cl.
*H01R 24/64* (2011.01)
*H01R 13/703* (2006.01)

(52) U.S. Cl.
CPC ..... *H01R 24/64* (2013.01); *H01R 13/7036* (2013.01); *H01R 2201/04* (2013.01)

(58) Field of Classification Search
CPC . H01R 24/64; H01R 13/7036; H01R 2201/04
See application file for complete search history.

(56) References Cited

U.S. PATENT DOCUMENTS 3,980,372 A * 9/1976 Ranzanigo ..... H01R 13/4532 439/139
3,990,758 A * 11/1976 Petterson ..... H01R 13/4536 439/138
4,037,901 A * 7/1977 Kaszuba ..... H01R 13/4532 439/138

(Continued)

FOREIGN PATENT DOCUMENTS

DE 102008052857 4/2010
DE 202015106121 2/2017

*Primary Examiner* — Alexander Gilman
(74) *Attorney, Agent, or Firm* — Boyle Fredrickson, S.C.

(57) ABSTRACT

The invention relates to an electrical plug-in connector, in particular for the combined transmission of data and electrical power, comprising a housing, comprising a plurality of first contact areas for connection to matching contact areas of a further plug-in connector, comprising a plurality of electrically conductive conductor arrangements in the housing and comprising a plurality of connection contacts for connection to a line which leads to the plug-in connector, wherein in each case a first contact area is connected to a connection contact by means of a conductor arrangement, wherein at least one of the conductor arrangements has means for disconnecting and closing an electrically conductive connection using this conductor arrangement.

4 Claims, 11 Drawing Sheets

(56) References Cited

U.S. PATENT DOCUMENTS

| | | | | | |
|---|---|---|---|---|---|
| 4,148,536 | A * | 4/1979 | Petropoulsos | H01R 13/7036 | 200/51.09 |
| 4,179,175 | A * | 12/1979 | Farnworth | H01R 13/7036 | 200/51.09 |
| 4,185,881 | A * | 1/1980 | Foley | H01R 13/4532 | 439/188 |
| 4,283,102 | A * | 8/1981 | Richier | H01R 13/7036 | 439/140 |
| 4,932,886 | A * | 6/1990 | Glaser | H01R 13/6395 | 439/137 |
| 5,277,602 | A * | 1/1994 | Yi | H01R 13/7036 | 439/138 |
| 6,530,806 | B2 * | 3/2003 | Nelson | H01R 13/71 | 200/51.09 |
| 7,641,489 | B1 * | 1/2010 | Hsu | H01R 13/4538 | 439/188 |
| 7,820,909 | B2 * | 10/2010 | Castaldo | H01R 13/4534 | 174/53 |
| 7,931,484 | B2 * | 4/2011 | Chen | H01R 13/635 | 439/188 |
| 9,059,550 | B2 * | 6/2015 | Beak | H01R 13/7036 | |
| 9,472,892 | B1 * | 10/2016 | Rollmann | H01R 13/7036 | |
| 9,761,985 | B1 * | 9/2017 | Peng | H01R 13/4534 | |

* cited by examiner

ELECTRICAL PLUG-IN CONNECTOR

FIELD OF THE APPLICATION

The invention relates to an electrical plug-in connector, in particular for the combined transmission of data and electrical power, comprising a housing, comprising a plurality of first contact areas for connection to matching contact areas of a further plug-in connector, comprising a plurality of electrically conductive conductor arrangements in the housing and comprising a plurality of connection contacts for connection to a line which leads to the plug-in connector, wherein in each case a first contact area is connected to a connection contact by means of a conductor arrangement.

BACKGROUND

When electrical contacts which carry voltage or through which current flows are disconnected, a switching arc or colloquially a spark is produced. In the case of small currents and low voltages, only so-called breaking sparks or switching sparks which extinguish themselves occur. In the case of larger currents and voltages, the production of the arc is prevented by special components or rapid breakdown, for example by an arc extinguishing chamber, of the spark is sufficient in order to prevent damage to the contacts due to the higher temperatures in the switching arc. These measures are known as spark quenching and are used in power engineering. Switching sparks and switching arcs are produced because the electric current continues to flow in the form of a spark discharge or an arc discharge after opening of the contacts. When contacts are closed, there is approximately homogeneous current distribution. When contacts are disconnected or isolated, there is initially a concentration of the current density at the last contact point. As opening is continued, the switching arc between the contacts then develops at the last contact point or else a plurality of contact points. Switching sparks and switching arcs lead to interference emissions and to contact wear. If the switching arc is not suppressed or extinguished quickly enough, this leads to destruction of the switching contacts by contact erosion, in particular at high currents and voltages. In the worst case, this can lead to contacts being welded together and it no longer being possible to isolate the said contacts. Self-quenching switching sparks also lead to contact wear and premature failure of components over time. The higher the current intensity and/or the voltage, the more powerful the switching arc produced in the process. In the case of DC transmission, spark suppression is even more important since there is no zero voltage crossing, as in the case of alternating current, which can extinguish the switching arc itself. In the case of so-called Power-over-Ethernet (PoE) applications, plug-in connectors, for example RJ45 plug-in connectors or USB plug-in connectors, are used not only for the transmission of data but rather additionally for the transmission of electrical power. The contact areas of plugs of this kind for the combined transmission of data and electrical power are of very thin design. In the case of plugs of this kind, increased contact wear or even contact erosion between two contact areas can occur when the said plugs are inserted into or pulled out of a socket.

SUMMARY

The aim of the invention is to improve an electrical plug-in connector.

To this end, the invention provides an electrical plug-in connector, in particular for the combined transmission of data and electrical power, comprising a housing, comprising a plurality of first contact areas for connection to matching contact areas of a further plug-in connector, comprising a plurality of electrically conductive conductor arrangements in the housing and comprising a plurality of connection contacts for connection to a line which leads to the plug-in connector, wherein in each case a first contact area is connected to a connection contact by means of a conductor arrangement, wherein at least one of the conductor arrangements has means for disconnecting and closing an electrically conductive connection by way of this conductor arrangement.

Therefore, in order to protect the plug/socket connection, the invention proposes that, when the conditions for the production of a switching arc are present, this switching arc is moved onto the conductor arrangements, so that the arc therefore does not occur between the first contact areas of the plug-in connector and matching contact areas of a further plug-in connector. As a result, the switching arc which is produced or else the plurality of switching arcs which occur can be moved to suitably dimensioned contact areas, for example inside the plug-in connector, so that the first contact areas, which are provided for connection to matching contact areas of a further plug-in connector, can be designed in accordance with the required standard, for example RJ45 or USB. As a result, the first contact areas for connection to matching contact areas of a further plug-in connector can, without problems, be designed to be very thin and also such that they can be subjected to less stress in respect of the production of switching sparks or switching arcs since the switching sparks or switching arcs are produced at contact areas, which are designed for this purpose, in the region of the conductor arrangements and the disconnecting and closing means. In other words, a leading contact is therefore realized in the region of the conductor arrangements, which leading contact, when two plug-in connectors are isolated, breaks the connection before the first contact areas are detached from the matching contact areas of a further plug-in connector. During connection, the first contact areas are first electrically conductively connected to the matching contact areas of a further plug-in connector and only then are current and voltage applied to the connection of the first contact areas to matching contact areas of a further plug-in connector by means of that contact, which lags during the insertion operation, of the means for disconnecting and closing the conductor arrangement.

In a development of the invention, the disconnecting and closing means are designed, when the further plug-in connector is withdrawn from the plug-in connector, to effect the disconnection of the at least one conductor arrangement before the isolation of the first contact areas from the matching contact areas of the further plug-in connector.

In a development of the invention, the disconnecting and closing means are designed, when the further plug-in connector is inserted into the plug-in connector, to effect the closing of the at least one conductor arrangement after the at least partial connection of the first contact areas to the matching contact areas of the further plug-in connector.

Therefore, leading isolation is realized by the disconnecting and closing means during the disconnection of two plug-in connectors, for example a plug/socket connection, and a lagging contact-making connection is realized by the disconnecting and closing means during the connection of two plug-in connectors, for example a plug/socket connection.

In a development of the invention, the disconnecting and closing means have second electrically conductive contact areas, third electrically conductive contact areas and means for moving the first and second contact areas between a closed position, in which the first and the second contact areas are in contact, and an isolated position, in which the first and the second contact areas are arranged at a distance from one another.

In a development of the invention, the second contact areas are provided on plugs which are arranged inside the housing, and the third contact areas are provided on sockets which are arranged inside the housing, wherein the plugs and/or the sockets can be moved from the closed position to the isolated position inside the housing.

In a development of the invention, the sockets are designed as passage openings, which are metallized in sections, in a printed circuit board.

In this way, the sockets can be realized in a very compact and cost-effective manner.

In a development of the invention, the second contact areas or the third contact areas are arranged on a slide which is arranged in the housing in a displaceable manner.

In this way, firstly a reliable contact-making operation can be realized in the conductor arrangement by the disconnecting and closing means. Secondly, the disconnection operation which leads during the disconnection and the contact-making operation which lags during the connection can be realized in a reliable manner and by a compact design of the disconnecting and closing means.

In a development of the invention, the slide can be displaced by means of insertion of a further plug-in connector into the housing and/or pulling of the further plug-in connector out of the housing.

The kinetic energy required for the displacement of the slide is consequently applied when the plug-in connector is inserted or pulled out by an operator. In this way, no actuators are required inside the plug-in connector and the plug-in connector according to the invention can be realized in a structurally simple and extremely reliable manner.

BRIEF DESCRIPTION OF THE DRAWINGS

Further features and advantages of the invention can be gathered from the claims and the following description of preferred embodiments of the invention in conjunction with the drawings. Individual features of the different embodiments which are illustrated and described can be combined with one another in any desired manner in the process, even without the further features which are described or shown in conjunction with the respective individual features, without going beyond the scope of the invention. In the drawings:

DETAILED DESCRIPTION

Figure 1:
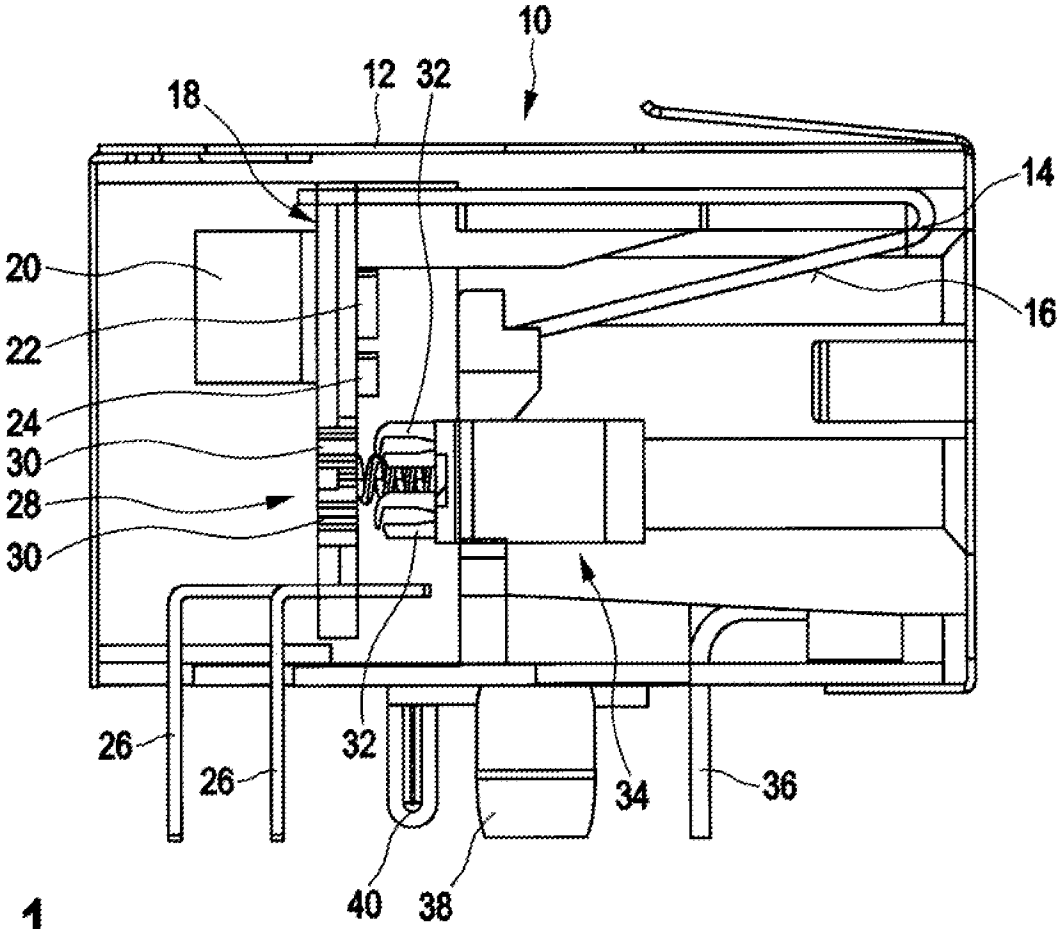
FIG. 1 shows a sectional view through a plug-in connector according to the invention in line with a first embodiment of the invention.

FIG. 1 shows a sectional view through the side of an electrical plug-in connector 10 according to the invention which is designed as an RJ45 socket. The plug-in connector 10 has a housing 12 in which a plurality of first contact clips 14 are provided. Only one of the contact clips 14 is shown in the illustration of FIG. 1. The contact clips 14 are each bent in a U-shape, wherein a first contact area 16 is provided on a limb, at the bottom in FIG. 1, which extends obliquely downwards. When a further, matching plug-in connector is inserted, the contact area 16 and also the further first contact areas 16, not visible in FIG. 1, serve to establish an electrical connection with the first contact areas 16 and therefore the contact clips 14. A second limb of the contact clips 14 leads to a printed circuit board 18 which has provided on it a plurality of conductor arrangements, which are connected to the first contact clips 14, and possibly also passive electronic elements 20, 22, 24 which are then connected to individual, a plurality of or else all of the conductor arrangements on or in the printed circuit board 18. Passive electronic elements 20, 22, 24 can be designed, for example, as coils, capacitors or else resistors and serve to ensure the operational performance of the electrical plug-in connector 10 in the intended frequency range. The first contact clips 14 are, in the upper region of the printed circuit board 18 in FIG. 1, connected to the conductor arrangements which are provided in the printed circuit board.

In that region of the printed circuit board 18 which is situated at the bottom in FIG. 1, a plurality of connection contacts 26 are connected to the printed circuit board 18 and to the conductor arrangements of the printed circuit board 18. These connection contacts 26 are provided for connecting the plug-in connector 10 to a line which leads to the plug-in connector 10, wherein this line is not illustrated in FIG. 1. The line which leads to the plug-in connector 10 can also be designed, for example, on a printed circuit board. The connection contacts 26, illustrated in FIG. 1, are provided, for example, for insertion into metallized passage openings of a printed circuit board.

In each case one of the first contact clips 14 is connected to one of the conductor arrangements on the printed circuit board 18, and in each case one of the conductor arrangements of the printed circuit board 18 is then connected to one of the connection contacts 26. Consequently, there is an electrical connection between in each case one connection contact 26, one of the conductor arrangements on the printed circuit board 18 and one of the first contact clips 14.

In order to be able to open and close this electrical connection by way of the conductor arrangement, means 28 for disconnecting and closing an electrically conductive connection of this kind by way of the conductor arrangement are provided in the electrical plug-in connector 10 according to the invention. These disconnecting and closing means have, firstly, passage openings 30, which are metallized in sections, in the printed circuit board 18 and secondly plugs 32 on a slide 34 which can be displaced in the housing 12.

In the state from FIG. 1, an electrical connection between the connection contacts 26 and the first contact clips 14 is disconnected or interrupted. The reason for this is that the plugs 32 are arranged at a distance from the passage openings 30 in the printed circuit board 18. If, for example, the connection contacts 26 are connected to a current- and voltage-carrying line, the first contact clips 14 are at zero current and at zero voltage in the state from FIG. 1.

An electrical connection is closed by way of the conductor arrangements on the printed circuit board 18, so that in each case one of the first contact clips 14 is then also electrically connected to one of the connection contacts 26, only when the slide 34 is moved to the left in the illustration of FIG. 1 until the plugs 32 are arranged in the passage openings 30 of the printed circuit board 18.

Further connection contacts 36 which serve to supply power to LEDs on the housing 12, but which are not illustrated, are provided on the bottom side of the housing 12. Further connection contacts 40 are provided for making contact with a shielding of the housing 12. Furthermore, the bottom side of the housing 12 is provided with latching hooks 38 with which the housing 12 can be mechanically anchored, for example in matching passage openings of a printed circuit board or else a device housing.

The plug-in connector 10 is, as has been mentioned, designed as an RJ45 socket and is provided for the combined transmission of data and electrical power. For example, in the so-called Power-over-Ethernet (PoE) standard, power is transmitted via data lines, wherein this electrical power is not only the electrical power which is required for data transmission. Rather, for example two cores of a data line are used for supplying direct current at up to 50 V.

Since the first contact areas 16 of the first contact clips 14 and also the matching contact areas of a further plug-in connector, therefore of an RJ45 plug in the embodiment from FIG. 1, were originally in no way designed for the transmission of electrical power in the DC voltage mode, the contact areas 16 are actually too small to transmit the required electrical powers without destruction in the long term. Switching sparks or switching arcs can be produced between the contact areas to be connected or to be isolated particularly when connecting and isolating RJ45 plug-in connectors, USB connectors or else other connectors which are usually only used for telecommunications. This can lead to destruction of the contact areas by contact erosion or even to welding of the contact areas. The production of switching sparks, breaking sparks or switching arcs between the contact areas to be connected or to be isolated leads to a considerable reduction in the service life of these contact areas in any case.

The plug-in connector 10 according to the invention provides a remedy here by way of the means 28 for isolating and closing an electrically conductive connection by way of the conductor arrangements in the printed circuit board 18.

In particular, as has already been explained, an electrical connection is isolated by way of the conductor arrangements in the printed circuit board 18 in the state from FIG. 1.

Figure 7:
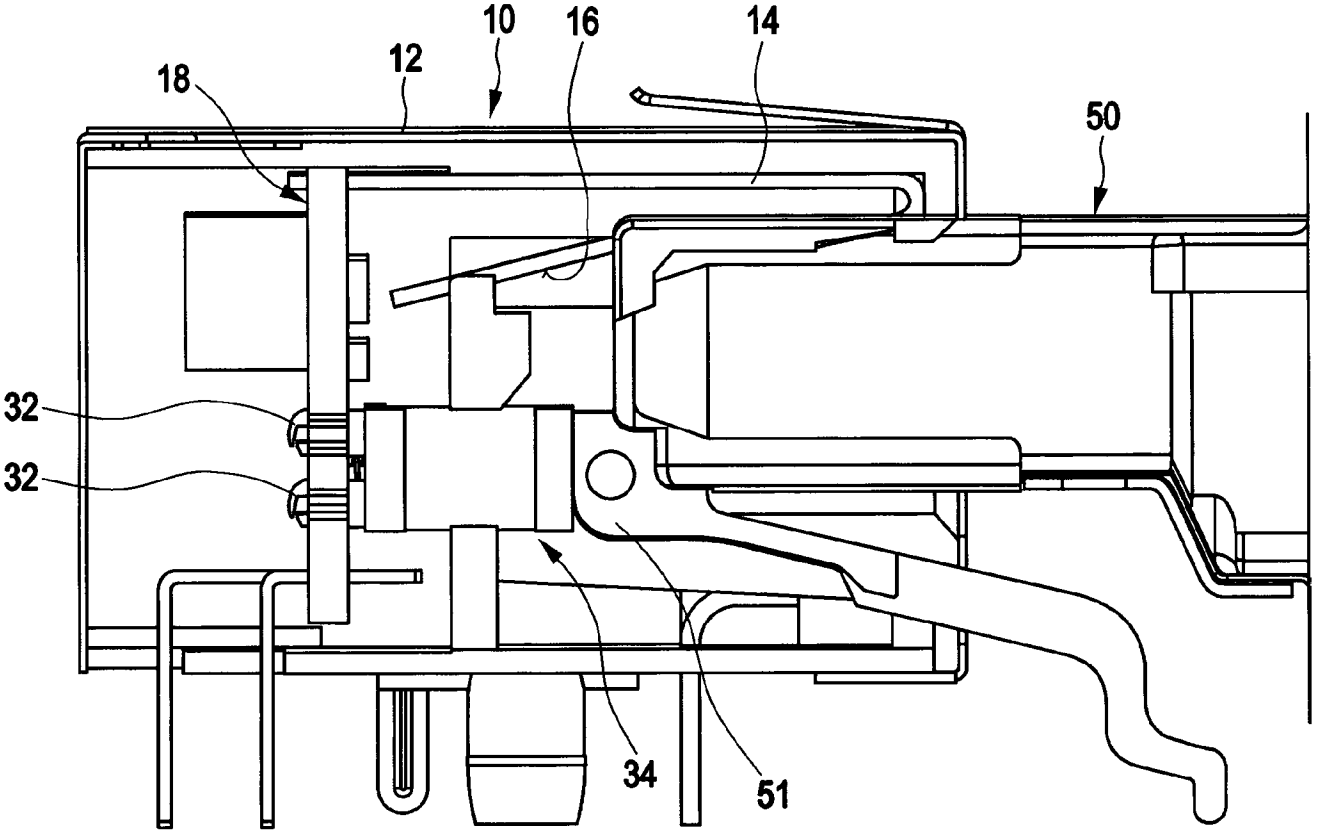
FIG. 7 shows the plug-in connector from FIG. 1 in a state in which a further, matching plug-in connector is inserted.

If a matching plug-in connector is now inserted into the electrical plug-in connector 10 from FIG. 1, also see FIG. 7, this matching plug-in connector pushes the slide 34 in FIG. 1 to the left until the plugs 32 are arranged in the passage openings 30 of the printed circuit board 18 and as a result close an electrical connection by way of the conductor arrangements in the printed circuit board 18. This closed state of the conductor arrangements is illustrated in FIG. 7.

However, the matching plug-in connector pushes the slide 34 into the position arranged on the left-hand side in FIG. 1, in which position an electrical connection is closed by way of the conductor arrangements in the printed circuit board 18, only after the contact areas of the further plug-in connector 50 are already in mechanical and electrical contact with the first contact areas 16 of the plug-in connector 10. As a result, it is possible to bring the contact areas of the further plug-in connector 50 into contact with the first contact-areas 16 of the plug-in connector 10 in a zero-current and zero-voltage state. The production of switching sparks or switching arcs when the first contact areas 16 of the plug-in connector 10 make contact with the contact areas of the further plug-in connector is therefore precluded.

The further plug-in connector 50 pushes the slide 34, starting from the position illustrated in FIG. 1, to the left, until the position illustrated in FIG. 7 is reached, only when the contact areas of the further plug-in connector are already in contact with the first contact areas 16 of the plug-in connector 10. During this movement of the further plug-in connector 50, that is to say from right to left in FIG. 1, the contact areas of the further plug-in connector 50 remain in mechanical and electrical contact with the first contact areas 16 of the plug-in connector 10. In other words, the first contact areas 16 slide along the contact areas of the matching plug-in connector until the position illustrated in FIG. 7 is reached.

Starting from the state from FIG. 7, the matching plug-in connector 50 is pulled out of the plug-in connector 10, that is to say to the right in FIG. 7. As soon as the matching plug-in connector 50 is moved to the right in FIG. 7, the slide 34 also moves to the right. Consequently, the plugs 32 are moved out of the passage openings 30 in the printed circuit board 18 until the state from FIG. 1 is reached, in which state the plugs 32 are therefore at a distance from the passage openings 30. In the state from FIG. 1, when the further plug-in connector 50 is still located in the housing 12 of the plug-connector 10 in sections, the contact areas of the further plug-in connector 50 are, however, still in mechanical and electrical contact with the first contact areas 16 of the first contact clips 14 of the plug-in connector 10. When the matching plug-in connector 50 is pulled out of the housing 12 of the plug-in connector 10 further to the right, the contact areas of the matching plug-in connector 50 become isolated from the first contact areas 16 of the plug-in connector 10. However, the isolation of the contact areas on both sides then takes place as early as in a zero-current and zero-voltage state since the electrical connection by way of the conductor arrangements in the printed circuit board 18 has already been disconnected beforehand by the slide 34 having been moved to the position illustrated in FIG. 1 and therefore the plugs 32 no longer being arranged in the passage openings 30 of the printed circuit board 18.

The plug-in connector 10 according to the invention has the effect that the first contact areas 16 of the plug-in connector 10 are brought into contact with the contact areas of the matching plug-in connector 50 only in a zero-current and zero-voltage state and are also isolated again only in a zero-current and zero-voltage state. Therefore, even when the plug-in connectors 10, 50 are used for the combined transmission of data and electrical power, for example by means of the PoE standard, there is no risk of switching sparks, switching arcs or the like, which could have a negative effect on the functioning or at least the service life of the plug-in connectors 10, 50, occurring on the contact areas 16. Any switching sparks, switching arcs or the like which do occur occur solely between the plugs 32 and the passage openings 30 which, however, are designed for this purpose and withstand significantly higher switching currents.

Figure 2:
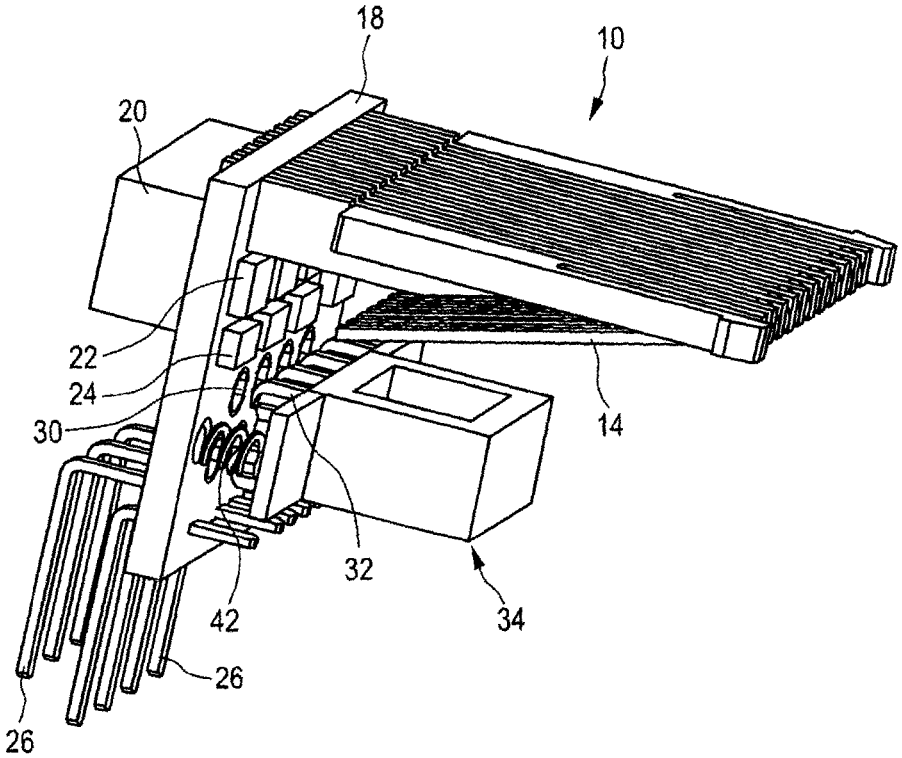
FIG. 2 shows a view of the plug-in connector from FIG. 1 without a housing obliquely from above.

The illustration of FIG. 2 shows the plug-in connector 10 in the state from FIG. 1 without the housing 12. The said figure shows the first contact clips 14 which, as has already been mentioned, lead, by way of their upper limb, to the printed circuit board 18 and, there, are electrically connected to conductor arrangements, not illustrated in FIG. 2. The conductor arrangements in or on the printed circuit board 18 are then at least partially connected to the passive electrical components 20, 22, 24 on the printed circuit board 18 and also to the passage openings 30, which are metallized in sections, in the printed circuit board 18. FIG. 2 clearly shows that in each case one section, situated at the top in FIG. 2, of the wall of the passage openings 30 is metallized, as is a section which is situated at the bottom in each case. These two metallized sections are isolated by two non-metallized sections of the wall, so that there is therefore no electrically conductive connection between these two metallized wall sections in the state from FIG. 2. A lower clip of the plug 32 is connected to the in each case lower wall section of the passage openings 30 and an upper limb is connected to the respectively upper metallized wall section of the passage openings 30 only when the plugs 32 of the slide 34 are arranged in the passage openings 30. The two limbs of the plugs 32 are electrically connected to one another inside the plug 34, this not being shown in FIG. 2. Therefore, when the plugs 32 are inserted into the passage openings 30 of the printed circuit board 18, the lower wall sections of the passage openings 30 are also electrically connected to the upper metallized wall sections of the passage openings 30 and therefore an electrical connection is then also closed by way of the conductor arrangements in the printed circuit board 18.

The illustration of FIG. 2 shows that a helical spring 42 is arranged between the printed circuit board 18 and the slide 34. A further helical spring 42 is arranged between the printed circuit board 18 and the slide 34 on that side of the slide 34 which is situated opposite the helical spring 42 and is hidden in FIG. 2. The helical springs 42 push the slide 34 into the position illustrated in FIG. 2 and FIG. 1, that is to say in which the plugs 32 are arranged at a distance from the passage openings 30 in the printed circuit board 18.

Figure 3:
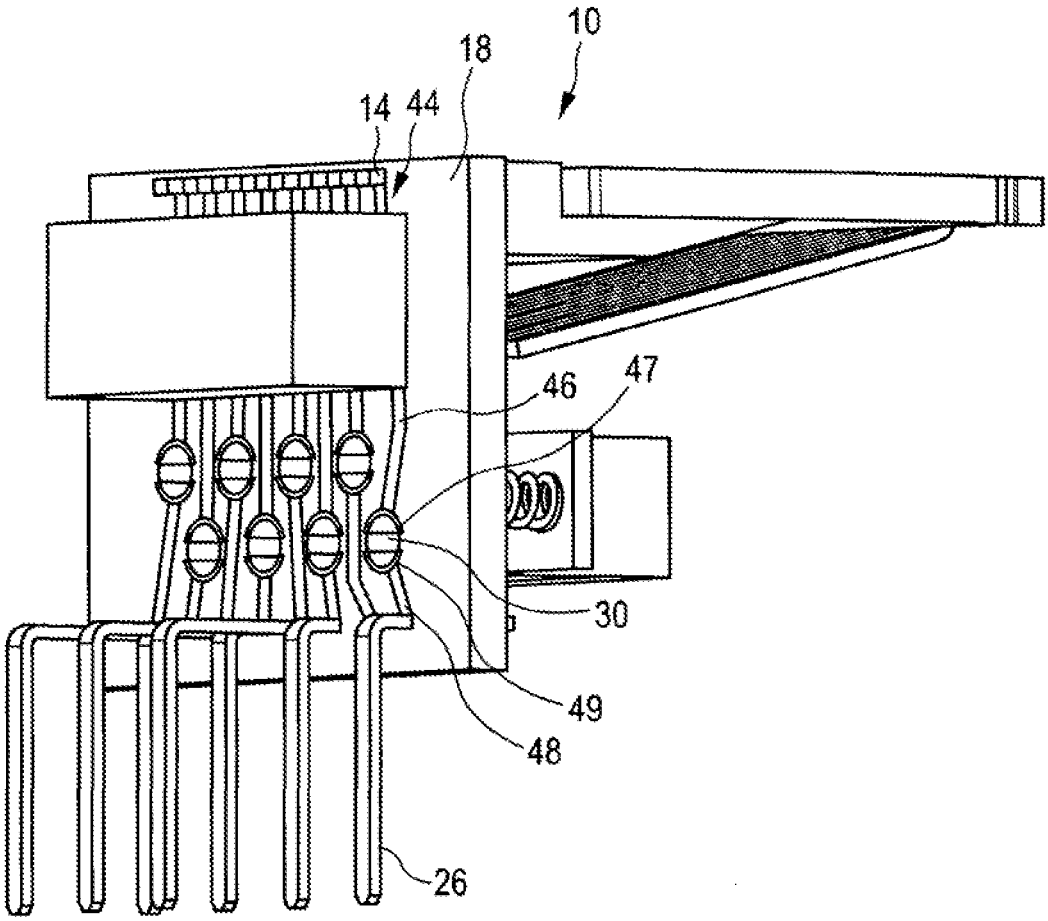
FIG. 3 shows the plug-in connector in the state from FIG. 2 from a different viewing direction.

The illustration of FIG. 3 shows the plug-in connector 10 according to the invention from FIG. 2 from a different viewing direction. A total of eight conductor arrangements 44 in the printed circuit board 18 are shown in this view. In each case one conductor arrangement 18 is associated with one of the eight first contact clips 14 and one of the eight connection contacts 26. Each of the conductor arrangements 44 leads across a passage opening 30 in the printed circuit board 18. Each of the conductor arrangements 44 has a first section 46 which is connected to in each case one of the first contact clips 14 and includes in each case one upper metallized wall section 47 of one of the passage openings 30. Furthermore, each of the conductor arrangements 44 has a second section 48 which is connected to in each case one lower wall section 49 of the passage openings 30 and is connected to in each case one of the connection contacts 26.

Therefore, in the state from FIG. 1, FIG. 2 and FIG. 3, an electrical connection is disconnected by means of the conductor arrangements 44, as is clearly shown, since there is no electrical connection between the respective lower wall sections 49 of the passage openings 30 and the upper wall sections 47 of the passage openings 30. As has already been mentioned, an electrical connection of this kind is established when the plugs 32 of the slide 34 are arranged in the passage openings 30. In this state, illustrated in FIG. 7, the electrical connections are then closed by means of the conductor arrangements 44.

Figure 4:
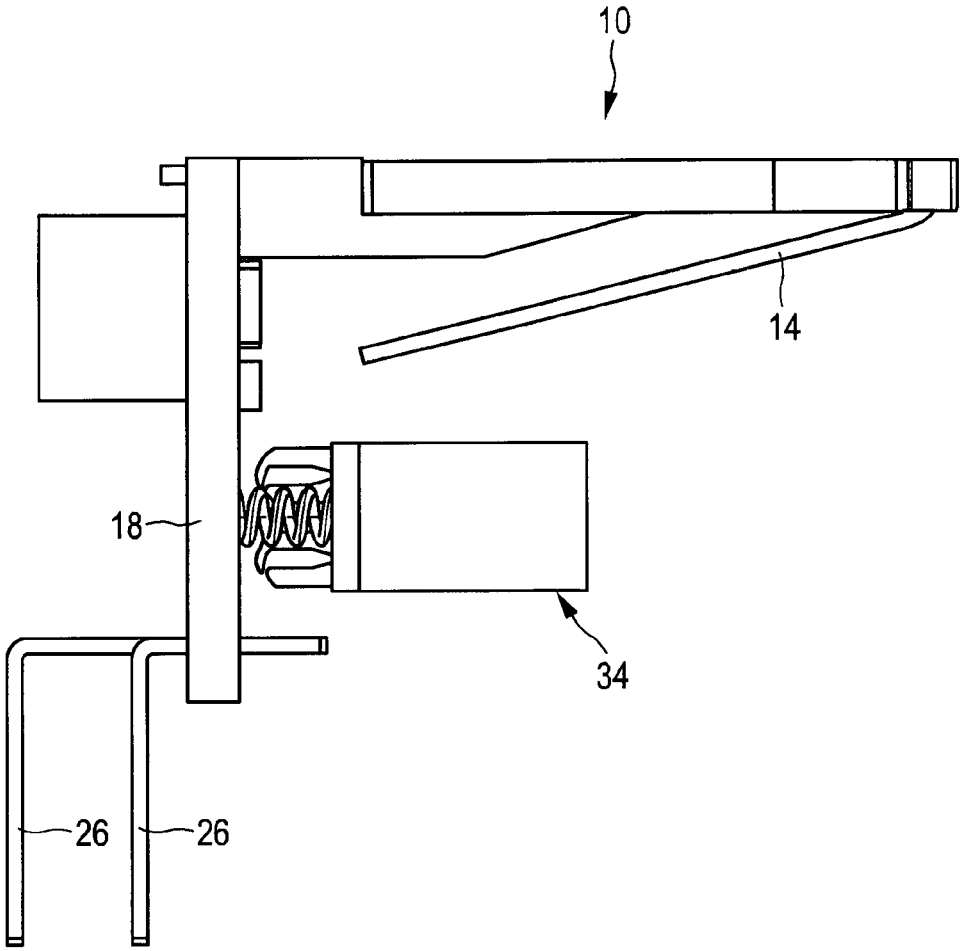
FIG. 4 shows the plug-in connector in the state from FIGS. 2 and 3 from the side.

The illustration of FIG. 4 shows the electrical plug-in connector 10 in the state from FIGS. 2 and 3 from the side.

Figure 5:
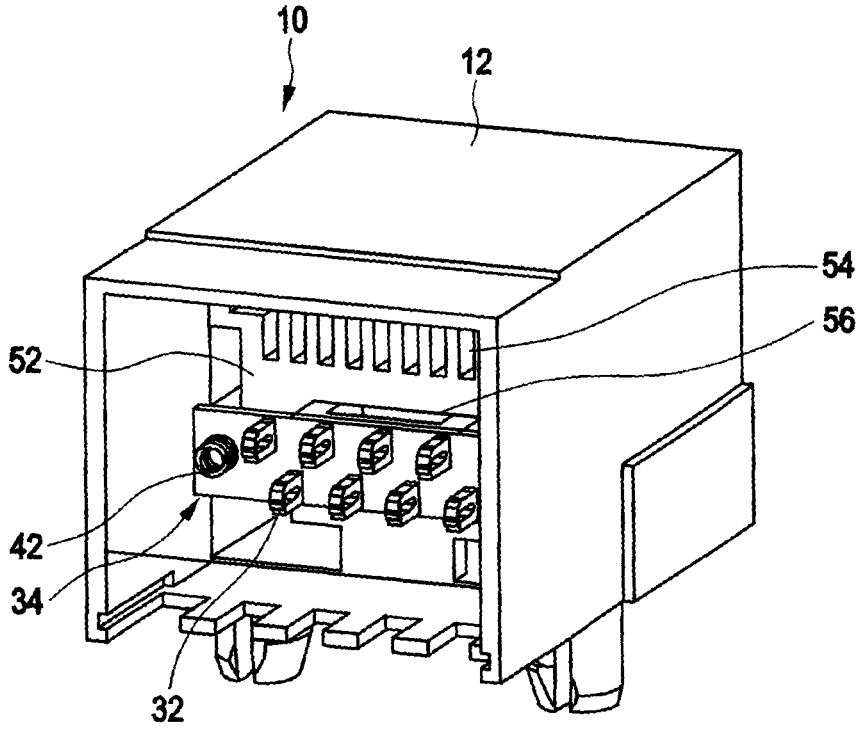
FIG. 5 shows the plug-in connector from FIG. 1 without contact areas or a conductor arrangement obliquely from the rear.

The illustration of FIG. 5 shows the plug-in connector 10 from FIG. 1 in the partially removed state. In particular, a rear side of the housing 12, which rear side is arranged on the left in FIG. 1, has been removed and the first contact clips 14, the printed circuit board 18 and the connection contacts 26 are not illustrated either. The view in FIG. 5 therefore shows the slide 34 with the plugs 32 and the helical springs 42. The said figure shows that a guide block 52 is provided in the housing 12, the said guide block being composed of an electrically insulating material and having slots 54 for arranging the first contact clips 14 and also a recess 56 in which the slide 34 is accommodated in a displaceable manner. The recess 56 is open in the direction of the side of the printed circuit board 18 and also in the direction of the rear side, hidden in FIG. 5, that is to say in the direction of the insertion opening of the housing 12. When the matching plug-in connector 50 is inserted, cf. FIG. 7, the matching plug-in connector 50 can therefore meet the rear side of the slide 34, hidden in FIG. 5, and then displace the said slide forwards in the recess 56, that is to say to the left in FIG. 1 and FIG. 7 and obliquely downwards to the left in FIG. 5.

Figure 6:
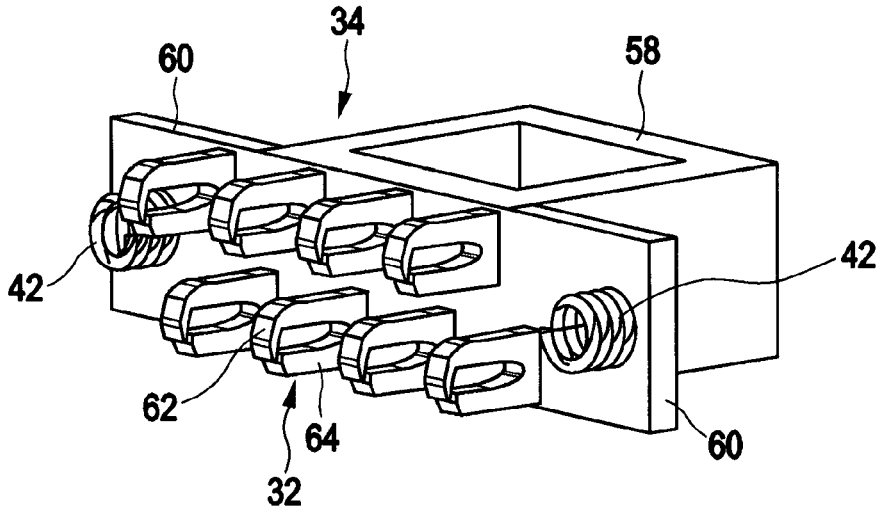
FIG. 6 shows an isolated illustration of the slide of the plug-in connector from FIG. 5.

The illustration of FIG. 6 shows the slide 34 in an isolated and enlarged illustration. The said figure shows that the slide 34 has a cuboidal main body 58. The top side, bottom side and the two side faces of the main body 58 bear against the wall sections of the recess 56 in the installed state of the slide 34, cf. FIG. 5, so that the slide 34 is guided in a displaceable manner in the housing 12 as a result.

When the matching plug-in connector 50 is inserted, the rear side of the main body 58, which rear side is arranged on the right-hand side and hidden in FIG. 6, is acted on by the said matching plug-in connector 50.

The front side of the main body, which front side is arranged on the left-hand side in FIG. 6, is extended in the direction of the sides by two lateral flange sections 60. Firstly, the two helical springs 42 are arranged in these flange sections, and secondly the flange sections 60 form a flat face with the front side of the main body 58, a total of eight plugs 32 then being arranged in the said flat face. Each of the plugs 32 has an upper limb 62 and a lower limb 64 and each of the plugs 32 is of integral design. The upper limb 62 and the lower limb 64 of each plug 32 are therefore permanently electrically connected. The plugs 32 are electrically insulated from one another and, by way of their rear sides which are hidden in FIG. 6, injection-moulded into the electrically insulating material of the slide 34 for example.

The illustration of FIG. 7 has already been explained and shows the further plug-in connector 50, designed as an RJ45 plug in the illustrated exemplary embodiment, in the inserted state in the plug-in connector 10, which is designed as an RJ45 socket. The further plug-in connector 50 is designed as a conventional RJ45 plug in the illustrated embodiment and has a projection 51 which forms that end of the plug-in connector 50 that is at the front in the insertion direction and which acts on a rear side of the slide 34.

Figure 8:
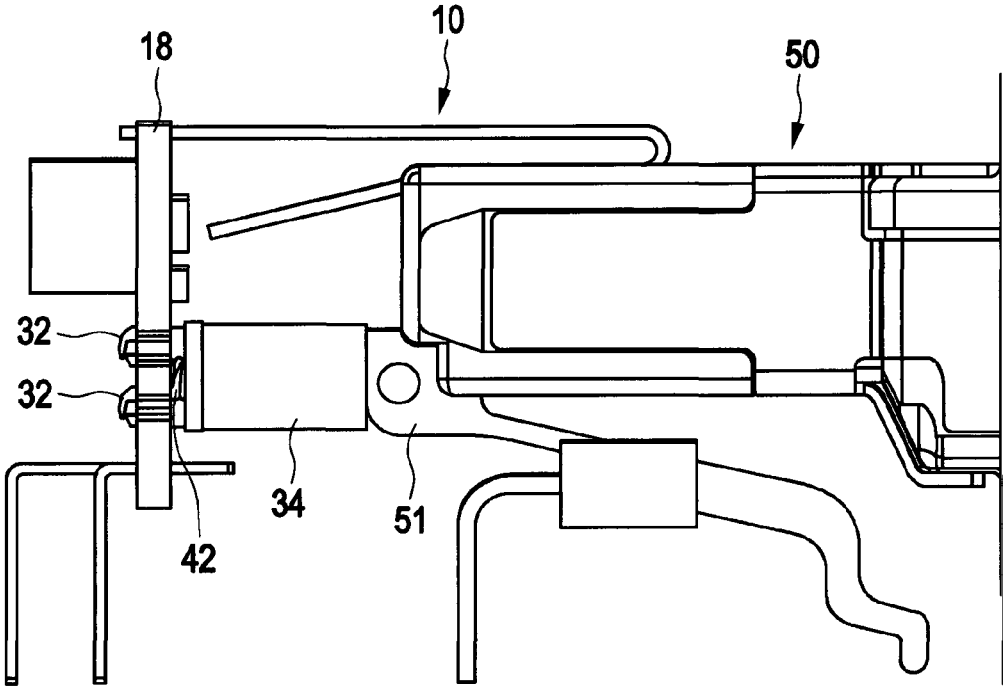
FIG. 8 shows the plug-in connector in the state from FIG. 7 without a housing.

The illustration of FIG. 8 shows the plug-in connector 10 and the matching plug-in connector 50 in the inserted state from FIG. 7, wherein the housing 12 of the plug-in connector 10 is not illustrated. The said figure clearly shows how the rear side of the slide 34 is acted on by the front side of the plug-in connector 50 and particularly the projection 51 and is pushed to the left against the force of the springs 42, so that the plugs 32 are arranged in the passage openings 30 of the printed circuit board 18.

Figure 9:
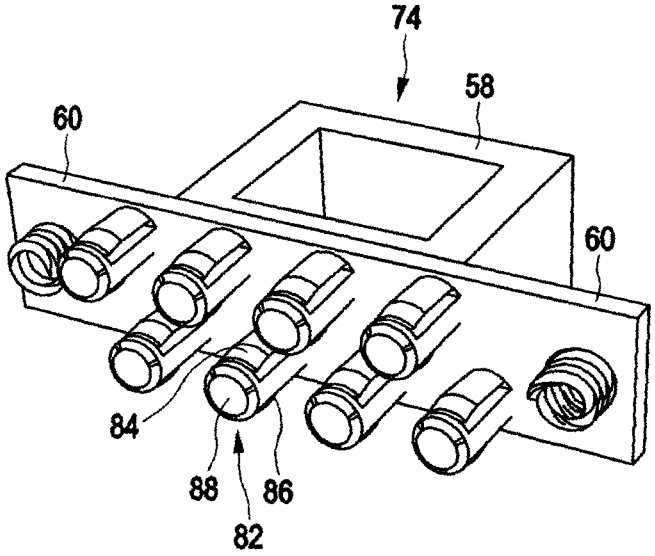
FIG. 9 shows an isolated illustration of the slide of a plug-in connector according to a further embodiment of the invention.

The illustration of FIG. 9 shows a slide 74 for a further embodiment of a plug-in connector according to the invention. The slide 74 differs from the slide 34 from FIG. 6 only by virtue of the design of the plugs 82. The main body 58 and the flanges 60 are identical.

The plugs 82 are designed as round plugs and have in each case an upper limb 84 and a lower limb 86 and a front cap 88. The two limbs 84, 86 can be moved towards one another to a slight extent, so that smooth insertion of the plugs 82 into the passage openings of the printed circuit board 18 is possible.

Figure 10:
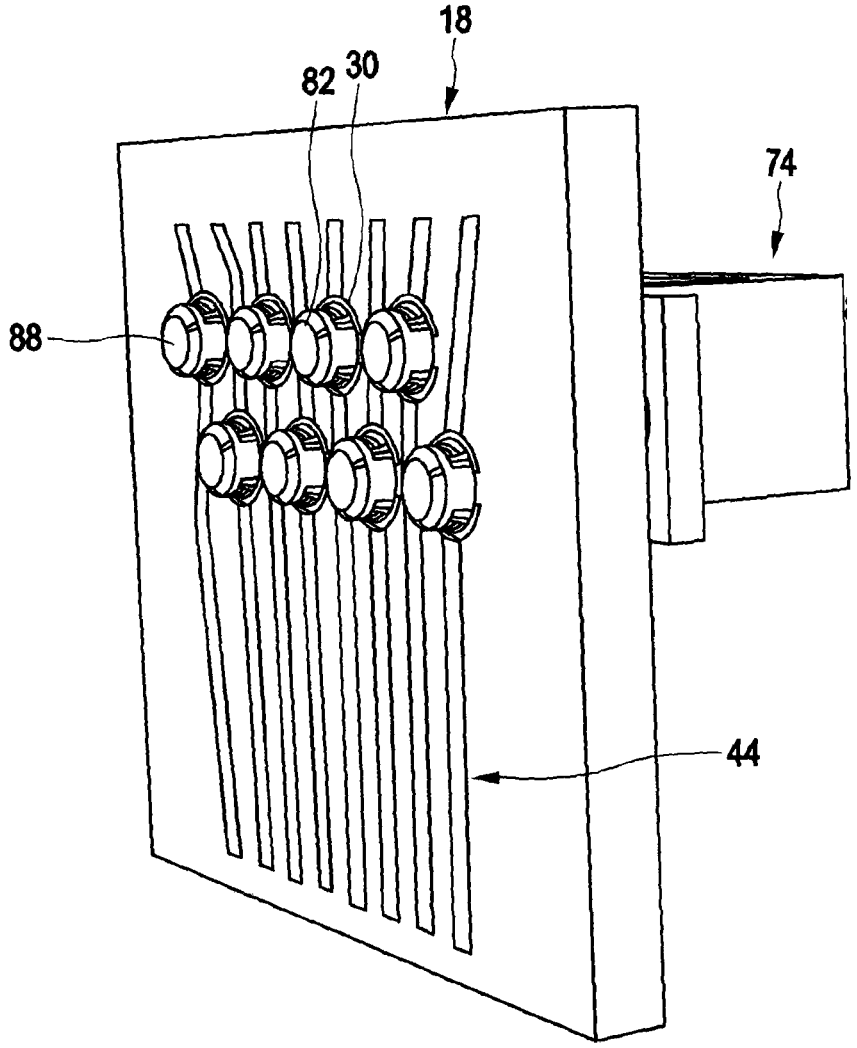
FIG. 10 shows the slide from FIG. 9 in a state in which the plug-in connector according to the invention is connected to a further, matching plug-in connector, wherein only the slide from FIG. 9 and a conductor arrangement of the plug-in connector according to the invention are illustrated.

FIG. 10 shows the slide 74 from FIG. 9 in the inserted state. In this state, the plugs 82 are therefore arranged in each case in a passage opening 30 of the printed circuit board 18 and, by way of their respective front cap 88, protrude beyond the rear side of the printed circuit board 18. The conductor arrangements 44 of the printed circuit board 18 have already been explained.

Figure 11:
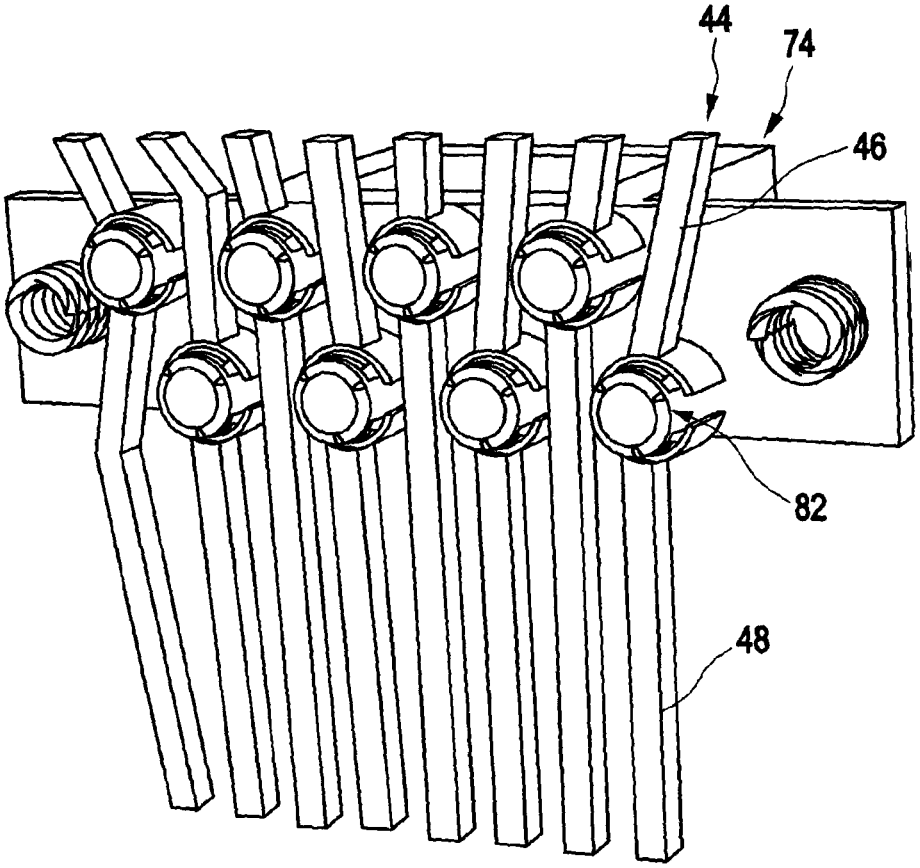
FIG. 11 shows an illustration of the slide and the conductor arrangement from FIG. 10 from a different viewing angle, wherein a printed circuit board, which carries the conductor arrangements, has been omitted.

FIG. 11 shows the slide 74 from FIG. 9 and FIG. 10 in the inserted state, wherein the printed circuit board 18 has been only partially illustrated, so that the electrically insulating material of the printed circuit board 18 is not illustrated and only the conductor arrangements 44 are illustrated. This view clearly shows the respective first sections 46 of the conductor arrangements 44 which comprise a rod-like conductor section and the curved metallization of the upper wall section of a passage opening 30. This view further shows the second sections 48 of the conductor arrangements 44 which comprise in each case one rod-like conductor section and the curved metallizations of the lower wall sections of the passage openings 30.

The illustration of FIG. 11 once again clearly shows how, in the inserted state, the plugs 82 connect the metallization of the respective lower wall section to the metallization of the respective upper wall section of the passage openings 30 and in this way close an electrical connection by way of the conductor arrangements 44.

The invention claimed is:

1. Electrical plug-in connector, in particular for the combined transmission of data and electrical power, comprising a housing;

a plurality of first contact areas for connection to matching contact areas of a further plug-in connector;

a plurality of electrically conductive conductor arrangements in the housing; and a plurality of connection contacts for connection to a line which leads to the plug-in connector, wherein in each case a first contact area is connected to a connection contact by means of a conductor arrangement for transmitting data and electrical power between the line and the first contact areas, wherein at least one of the conductor arrangements has means for disconnecting and closing an electrically conductive connection using this conductor arrangement, wherein the disconnecting and closing means have second electrically conductive contact areas, third electrically conductive contact areas and means for moving the first and second contact areas between a closed position, in which the first and the second contact areas are in contact, and an isolated position, in which the first and the second contact areas are arranged at a distance from one another, wherein the second contact areas are provided on plugs which are arranged inside the housing, and the third contact areas are provided on sockets which are arranged inside the housing, wherein the plugs and/or the sockets can be moved from the closed position to the isolated position inside the housing, wherein the sockets are designed as passage openings, which are metallized at least in sections, in a printed circuit board, and wherein the second contact areas or the third contact areas are arranged on a slide which is arranged in the housing in a displaceable manner.

2. Electrical plug-in connector according to claim 1, wherein the disconnecting and closing means are designed, when the further plug-in connector is withdrawn from the plug-in connector, to effect the disconnection of the at least one conductor arrangement before the isolation of the first contact areas from the matching contact areas of the further plug-in connector.

3. Electrical plug-in connector according to claim 1, wherein the disconnecting and closing means are designed, when the further plug-in connector is inserted into the plug-in connector, to effect the closing of the at least one conductor arrangement after the at least partial connection of the first contact areas to the matching contact areas of the further plug-in connector.

4. Electrical plug-in connector according to claim 1, wherein the slide can be displaced by means of insertion of the further plug-in connector into the housing and/or pulling of the further plug-in connector out of the housing.

* * * * *